US012703974B2

(12) United States Patent
Simonsen

(10) Patent No.: US 12,703,974 B2
(45) Date of Patent: Aug. 11, 2026

(54) PREMANUFACTURED WALL SYSTEMS

(71) Applicant: David John Simonsen, Redding, CA (US)

(72) Inventor: David John Simonsen, Redding, CA (US)

(73) Assignee: True Blue Products, LLC, Phoenix, AZ (US)

( * ) Notice: Subject to any disclaimer, the term of this patent is extended or adjusted under 35 U.S.C. 154(b) by 369 days.

(21) Appl. No.: 18/205,500

(22) Filed: Jun. 3, 2023

(65) Prior Publication Data

US 2023/0392371 A1 Dec. 7, 2023

Related U.S. Application Data

(60) Provisional application No. 63/348,016, filed on Jun. 2, 2022.

(51) Int. Cl.
*E04B 2/58* (2006.01)
*E04B 1/68* (2006.01)

(52) U.S. Cl.
CPC ..... *E04B 2/58* (2013.01); *E04B 1/6801* (2013.01)

(58) Field of Classification Search
CPC ..... E04B 1/6801; E04B 2/58; E04B 1/24
USPC ..... 52/474
See application file for complete search history.

(56) References Cited

U.S. PATENT DOCUMENTS

| | | | | |
|---|---|---|---|---|
| 5,634,310 | A * | 6/1997 | Hohmann | E04B 1/7616 52/565 |
| 6,817,147 | B1 * | 11/2004 | MacDonald | E04B 2/7433 52/712 |
| 8,555,596 | B2 * | 10/2013 | Hohmann, Jr. | E04B 1/4178 52/712 |
| 8,898,980 | B2 * | 12/2014 | Hohmann, Jr. | E04B 1/4178 52/712 |
| 9,340,968 | B2 * | 5/2016 | Hohmann, Jr | E04B 2/46 |
| 9,567,752 | B2 * | 2/2017 | McCandless | E04F 13/0807 |
| 9,803,355 | B1 * | 10/2017 | Ripley | E04B 1/7616 |
| 9,945,414 | B1 * | 4/2018 | Rodenhouse | F16B 43/001 |
| 10,221,563 | B2 * | 3/2019 | Miks | E04F 13/142 |
| 10,519,649 | B2 * | 12/2019 | Hohmann, Jr. | E04B 2/707 |
| 10,968,638 | B1 * | 4/2021 | Hohmann, Jr. | E04B 1/4178 |
| 11,473,609 | B2 * | 10/2022 | Chen | F16B 33/004 |
| 11,578,483 | B2 * | 2/2023 | Schoenhard | E04B 2/58 |
| 2006/0198717 | A1 * | 9/2006 | Fuest | F16M 13/02 411/401 |
| 2017/0159293 | A1 * | 6/2017 | Haley | E04F 13/0803 |
| 2020/0018063 | A1 * | 1/2020 | LeBlang | F16B 7/22 |
| 2021/0071410 | A1 * | 3/2021 | Kralic | E04B 2/58 |

* cited by examiner

*Primary Examiner* — Paola Agudelo

(57) ABSTRACT

Complete, economical, weather resistant, and energy efficient pre-manufactured wall assemblies including framing through finished façade.

6 Claims, 15 Drawing Sheets

FIG. 5
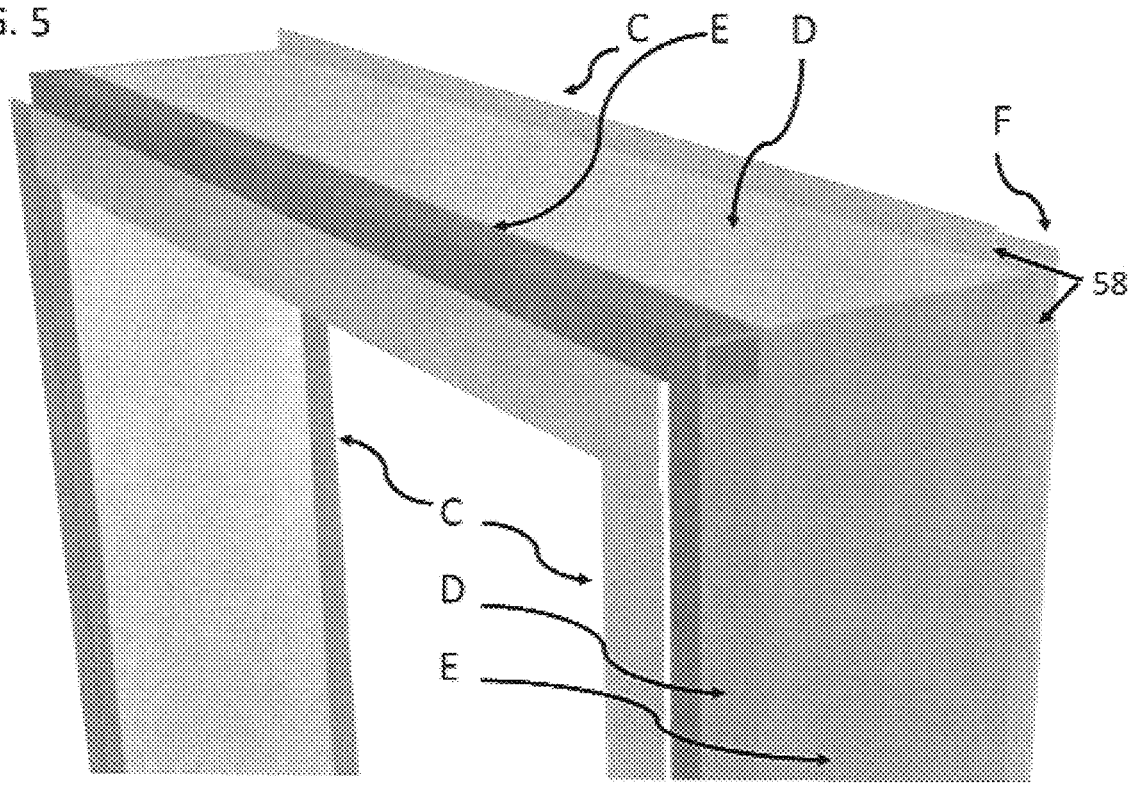
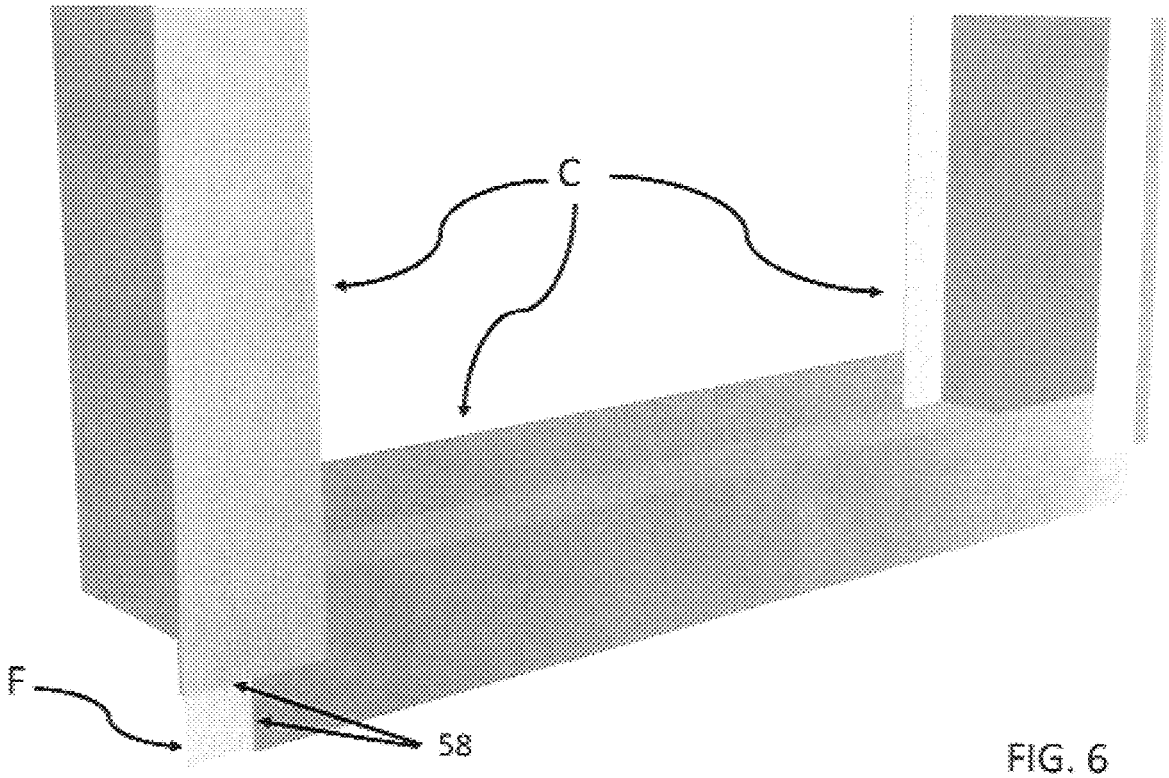
FIG. 6

FIG. 9
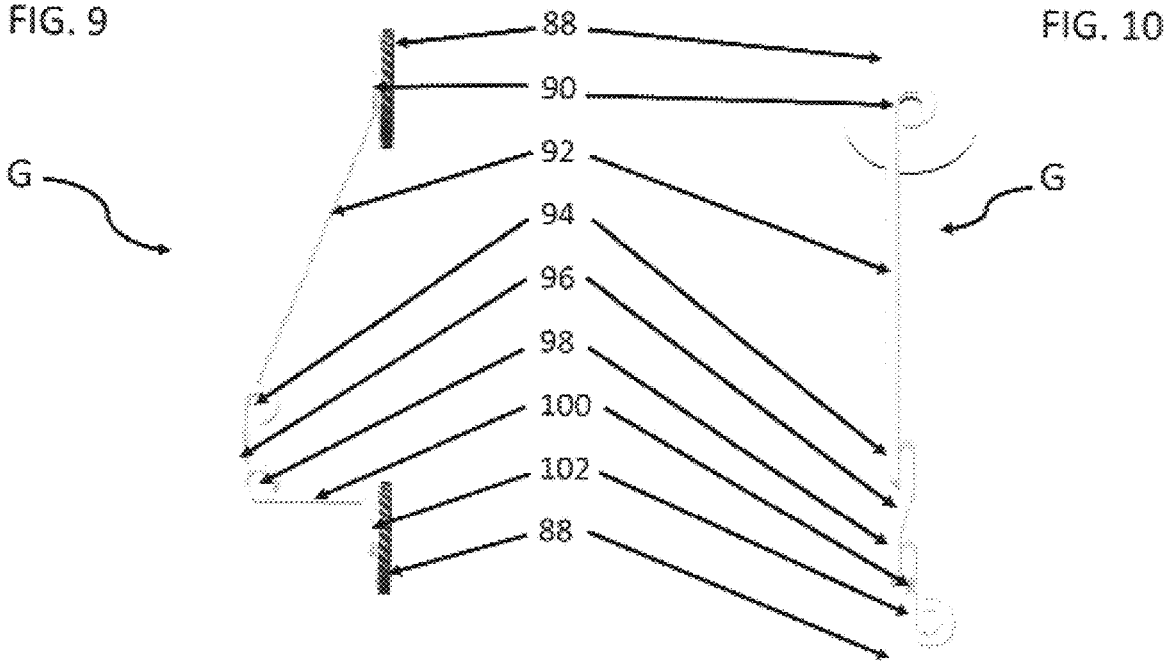
FIG. 10
FIG. 11
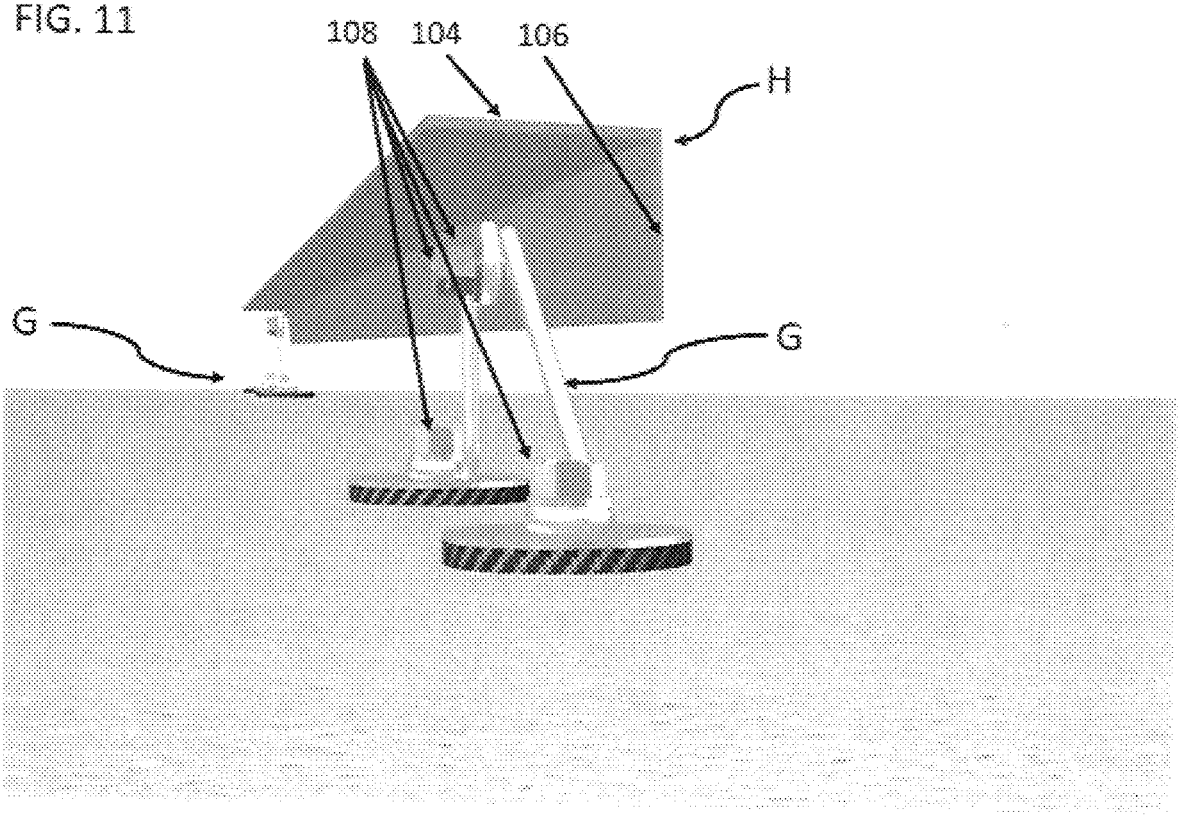

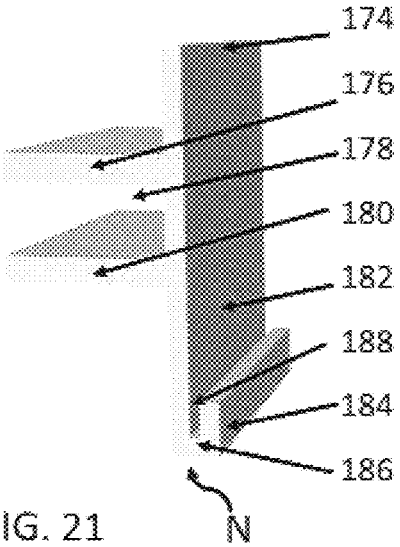
FIG. 21
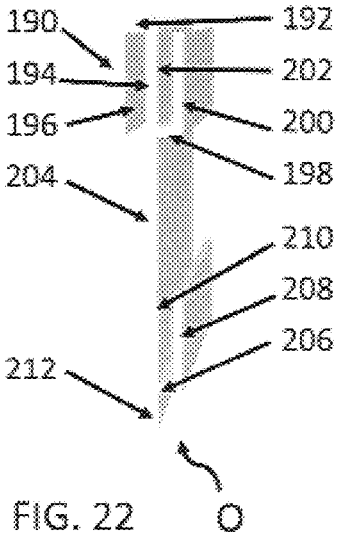
FIG. 22
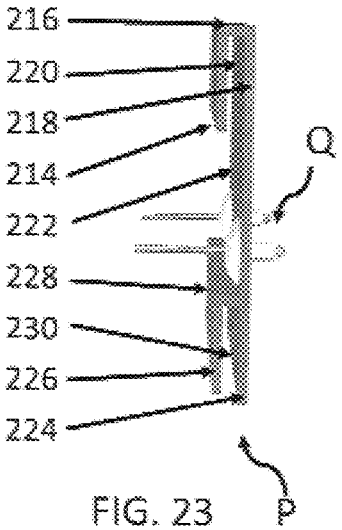
FIG. 23
FIG. 24
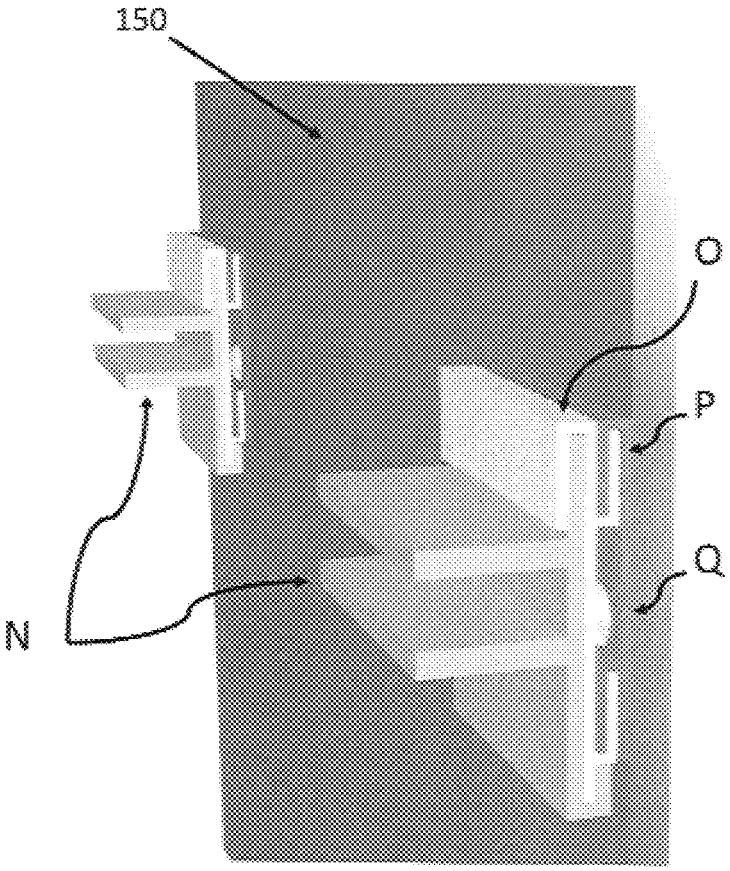

FIG. 26
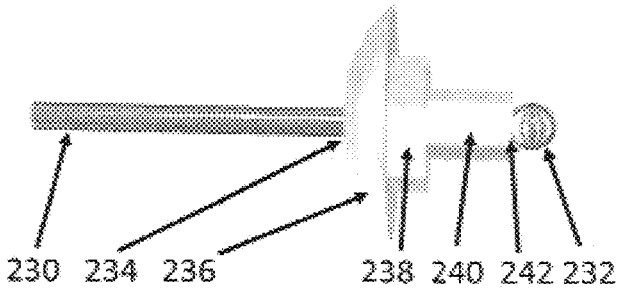
FIG. 27
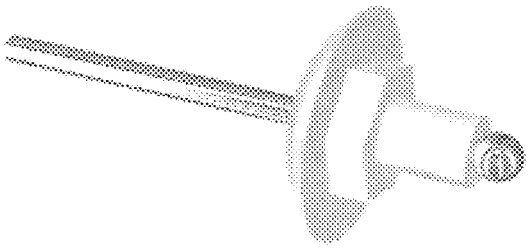
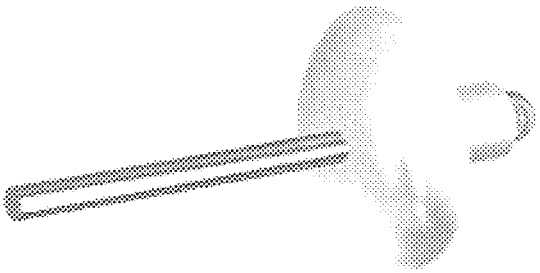
FIG. 28
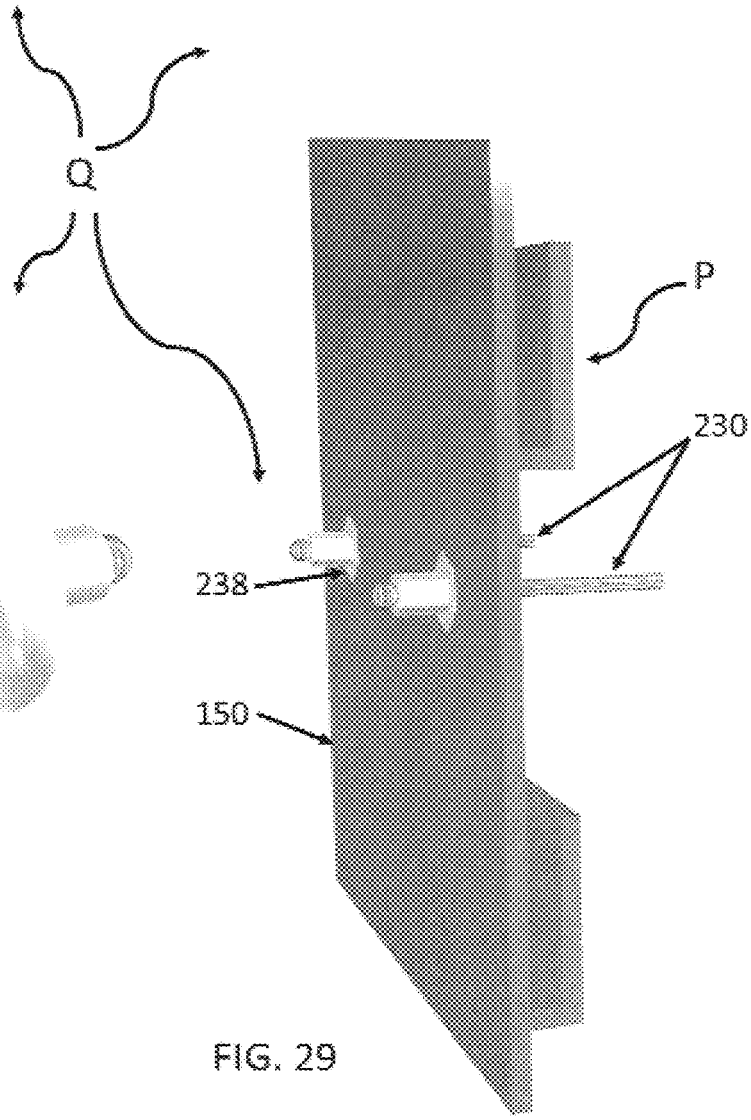
FIG. 29

PREMANUFACTURED WALL SYSTEMS

CROSS REFERENCES TO RELATED APPLICATIONS

The present application claims the benefit of U.S. Provisional Patent Application Ser. No. 63/349,016 filed Jun. 2, 2022.

BACKGROUND OF THE INVENTION

The present invention relates to a means of creating new and improved premanufactured wall systems which significantly reduce the weight of fully fabricated wall panels while adding strengths in several ways, providing much better thermal performance which as traditionally been very poor, provides a means of weather-proofing the wall panel to adjacent wall panels, and provides façade mounting systems which allow most façade materials to be fabricated and mounted in the same way so that there's consistency in the manufacturing process.

The present invention provides fewer penetrations through the weather barrier while sealing the penetrations which are made, while providing an extremely fast assembly of all components far a complete wall system by minimizing the number of processes required. All of these would be a notable advance in these fields.

BRIEF SUMMARY OF THE INVENTION

In accordance with the present application, novel and useful Premanufactured Wall Systems is herein provided which includes a new stud which reduces up to 20% of the steel content per stud while increasing bend strengths, a new track system which is used as the full perimeter of the framed wall assembly to help with waterproofing and insulating, vertical and horizontal thermal clips which can be used for vertical or horizontal sub-girt applications and provide for extreme thermal efficiency, energy saving sub-girts which eliminate slots for thermal expansion and problems with dis-similar metal usage, as well as a new universal panel mounting clip (rivet clip) which may be used with many types of façade materials such as Metal Composite Materials (MCM), aluminum and steel sheet products, phenolics, fiber cements and others. There will also be a new pem-rivet which will be a combination of a pem-nut and a rivet which is mechanically inserted into a metal or other substrate to permanently hold it in place until a rivet gun is used to pull the rivet shank through and expand the rivet body.

The steel studs will have a custom shape and be made with higher ksi carbon steel (or other structural material(s)) and made on a custom roll-former with punching stations. The studs will have dual flanges with the inner flanges positionally fixed in a groove in the web which will prevent the inner flanges from moving to offer more overall strength of the stud. They may also be made with a turret press and folding machine or brake press. The steel studs will provide the bend resistance needed for curtainwall applications.

The track system will be made of stainless steel (or other low-thermal transfer material) and made on a roll-former. The tracks will be used on all 4 sides of wall panels to help seal the panel's joints from weather when wall panels are mounted adjacent to each other on a building, as well as to support rubber-like seals and insulation materials. This type of track system may be used in place of traditional tracks and studs, or installed over tracks and studs as a means to reduce thermal transfer at wall panel joint locations which are traditionally locations of high energy transfer providing low thermal performance of the complete wall assembly.

The rubber-like seals will be made of a material such as extruded rubber silicone or neoprene. They will be shaped to cover a flange and web partially or fully and may have insulation injected inside its hollow opening to both seal and insulate. This seal may be adhered or mechanically fastened to the stud or track to positionally hold in in place until the wall panels are installed and permanently hold them in place. The seal may have one or more sides having an incline plane to help hold adjacently placed insulation in place, pinching it between the seal and another surface of the track. The rubber-like seals may also have additional members to split up and/or strengthen hollow sections, such as a single hollow section having a separator in the middle creating two hollow sections and adding bend resistance when loads are applied perpendicular to the additional member. The shape of the rubber-like seal may also be round on non-adhered to track surfaces to better close-up potential gaps and seal when compressed.

The vertical and horizontal thermal clips will mount directly to thermal breaks, which will be neoprene/stainless steel washers. The thermal clip will utilize mechanical fasteners which engage the studs of the wall's substrate, and in some cases the track and/or stud such as in head, jamb and sill locations. The thermal clips will be made of stainless-steel wire (or other metal or material) which may be shaped by hand using manual wire bending tools, or on CNC controlled wire forming machines. The round and semi-round locations on the thermal clips will act as anti-reversal mechanisms by means of friction, torsion on the fastener, and/or having an end slightly elevated as to dig into the bottom of the head of fasteners to provide anti-rotation. These thermal clips utilize minimal materials and are extremely inexpensive to manufacture.

The sub-girts may be made of fiber reinforced plastics made using pultrusion processes, aluminum shapes made in extrusion processes, and/or formed stainless steel made using equipment such as turret and brake presses. More than one material may be used together to create a composite sub-girt which provides more strength and attributes than one material alone. Fiber reinforced plastics, extruded plastics and similar types of material help with reductions in thermal movement, thermal transfer, and/or problems associated with dissimilar metals.

The universal panel mounting clips will be made of a material such as stainless steel which is formed on a turret and brake press, or which may be formed using custom equipment having progressive punches and dies to limit manufacturing time. The formed steel iteration of this clip will double as the body of a rivet, making the clip part of a rivet assembly, with a minimum of one rivet per clip. Because there is not a separate rivet body, when the rivet shank is pulled through it enlarges the formed tubular shape made in the clip. The formed tubes are created with punches and dies which progressively push the clip material out the back and form the tubular shapes. The clips may also be made of material such as aluminum extrusions or fiber reinforced pultrusions with holes made using punching or drilling tools to provide an installation location in which custom pem-rivets will be installed. The universal panel mounting clips may have holes in the top so that self-tapping fasteners may be installed which, when inserted completely through the holes may act as a pushing device to help level a panel. These self-tapping fasteners may also provide the friction required to positionally fix some or all of the top of a panel from moving during thermal expansion and contraction, such as when placed in the middle of a panel so that the ends of a panel are still able to expand and contract. A U-shaped and barbed anti-reversal clip with side-tab may be installed to prevent the clips from lifting off when the tab is located over the clip and the barbed teeth are embedded in the sub-girt.

The pem-rivet will be comprised of a rivet shank which will be made in the traditional manner using punch and anvil formed wire with head core. The rivet shank will have all traditional attributes such as knurling and a core separation zone. The body of the rivet will be comprised of standard rivet head of any shape as well as a hexagon shape immediately adjacent to the bottom of the rivet head, followed by the traditional kernel rivet. These rivets will be installed into sheet metal with a press so that the hexagon shape fills a round hole similar to how pem-nuts are installed, displacing the round hole so that the fit it very tight. With the pem-rivets installed into the Universal panel mounting clips (or other sheet material) so that the rivets permanently become part of the universal panel mounting clip.

It may be apparent that novel and useful Premanufactured Wall Systems has been hereinabove described which will work and be used in a manner not consistent with conventional products and methods.

It is therefore an object of the present application to provide Premanufactured Wall Systems which are lighter, stronger, easier, and less expensive to manufacture compared to traditional practices.

It's another object of the present application to provide tracks which are used on all 4 sides of a structural wall assembly, not just head and sill locations, which increases the thermal performance at all joint locations which have traditionally been very poor thermal performers because of bridging of carbon steel studs or large aluminum extrusions bridging directly to the inside of the building.

It's another object of the present application to provide sub-girt systems with minimal usage of materials for the thermal clips and the sub-girts themselves, while providing a minimum of one shape which can be used as both the sub-girt and clip, and where the sub-girt section may be used as short clips or full-length.

It's another object of the present application to provide a Universal panel mounting clip which is the rivet or dual rivet so that, as an example, an extrusion doesn't need to be cut to length, have holes punched in it which match the hole patterns of the façade sheet material, and then have separate rivets installed to connect the aluminum clip to the façade material. Because the Universal panel mounting clip is the rivet, it's simply installed as-is making the process much faster and less expensive.

It's another object of the present application to provide a track system which fully encompasses a wall panel where traditionally it would only cover the head and sill locations, and where the head and right jamb (or one jamb) possess adhered or mechanically fastened neoprene gaskets and insulation of any type, while the sill track and left jamb track (or other jamb) do not have neoprene gaskets or insulation, so that when one fully formed panel is placed on top of the next, the neoprene gasket and insulation seal and insulate between the panels. When a wall panel is mounted to the side of another panel, the neoprene gasket and insulation seal and insulate between the panels like the top and bottom panel connections.

It's another object of this application to provide a track system which has neoprene gaskets and insulation on all 4 tracks, pre-installed on the tracks, with male and female shaped neoprene gaskets that interlock when panels are mounted one on top of the next, or one mounted to the side of the next, and where gravity and/or mechanical tightening of fasteners closes the gaps between the wall panels to seal and weatherproof the panels. The insulation would compress one onto the next to eliminate air gaps to help prevent thermal transfer.

Another object of this application to provide a track system which utilizes a material such as stainless steel as the tracks to minimize thermal transfer from the outside of the building to the inside of the building.

Another object of this application is to provide a track system which allows the flanges of one track to fit inside of the hemmed flange of adjacent tracks.

It's another object of this application to provide a track system where eye bolts may be mounted through the head track and into adhered or welded on nuts in order to lift each wall panel for installation onto a building with a crane, then leaving the eye bolt in place so that it becomes a pilot and centering device to go into a slot in the sill track of the wall panel above.

It's an object of this application that all components may have additional holes, bends, knurling, punching, addition of threads (such as to the body of the pem-rivet), built-in anti-rotation mechanisms and other features which don't depart from the spirit of this application.

It's another object of this application that the stud of FIG. 1 may be divided into two parts, which is each side of the dual flanged stud, with the center web #38 of FIG. 1 eliminated so that the two halves act independently of each other unless small pieces of metal, such as stainless steel, are mechanically fastened to tie each half together to create a complete stud with much less thermal bridging and much less steel used, sharing in axial, bend and other loading to provide more overall structural strength compared to the two halves not being connected.

This invention possesses other objects or advantages especially concerning particular characteristics and features thereof which will become apparent as the specification continues.

BRIEF DESCRIPTION OF THE SEVERAL VIEWS OF THE DRAWINGS

FIG. 5 is an isometric elevation view of a head track and right jamb track with neoprene gasketing adhered around the acute corner with rock mineral wool insulation adhered between the neoprene gasket and raised side of the track. No studs are shown within the track frame assembly.

FIG. 6 shows an isometric elevation view of a sill track and a left jamb track having no neoprene gasketing material or rock mineral wool insulation. No studs are shown within the track frame assembly, but a corner piece is adhered into place to help prevent water intrusion at these locations, partially held in place due to being sandwiched between the hems of two adjacently and perpendicularly mounted tracks.

FIG. 9 shows an elevation isometric view of a vertical thermal clip assembly, FIG. 10 shows a plan isometric view of the vertical thermal clip assembly of FIG. 9.

FIG. 11 shows an isometric plan view of two of the vertical thermal clips of FIG. 9 in line with each other and an L shaped sub-girt attached to both, ready for the installation of a façade system.

FIG. 21 shows an elevation isometric view of our FRP horizontal sub-girt.

FIG. 22 shows an elevation isometric view of an aluminum extrusion which will fit over the top of the pultrusion of FIG. 21 to provide additional pull-out strength.

FIG. 23 shows an elevation isometric view of an aluminum extrusion clip which has our pem-rivets installed in two locations and ready to be installed into a façade panel material.

FIG. 24 shows an elevation isometric view of the assembly of the pultrusion of FIG. 21 with the aluminum extrusion of FIG. 22 fit over the top of it, which is interlocked with the a aluminum extrusion clip of FIG. 23 having the pem-rivets engaged within a panel to support it as a façade material in at least 2 locations on the panel.

FIG. 26 shows a side isometric elevation view of the pem-rivet of this invention.

FIG. 27 shows a back isometric elevation view of the pem-rivet of this invention.

FIG. 28 shows a front isometric elevation view of the pem-rivet of this invention, FIG. 29 is a side elevation isometric view of pam-rivets of FIGS. 26 through 28 forcefully driven into a clip so that the hexagonal portion of the body of the pem-rivet is driven into a round hole, expanding and deforming the round hole to accept the hexagonal shape to join the pem-rivet to the clip, making a complete assembly a dual-shanked rivet clip.

DETAILED DESCRIPTION OF THE INVENTION

Various aspects of the present application will evolve from the following detailed description of the preferred embodiment thereof which should be taken in conjunction with the prior described drawings.

Embodiments and elements of the invention are identified by reference capital letter A followed by another capital letter to denote a variation of a component, if any. Assembled embodiments and elements are identified with a numeral 10.

Figure 1:
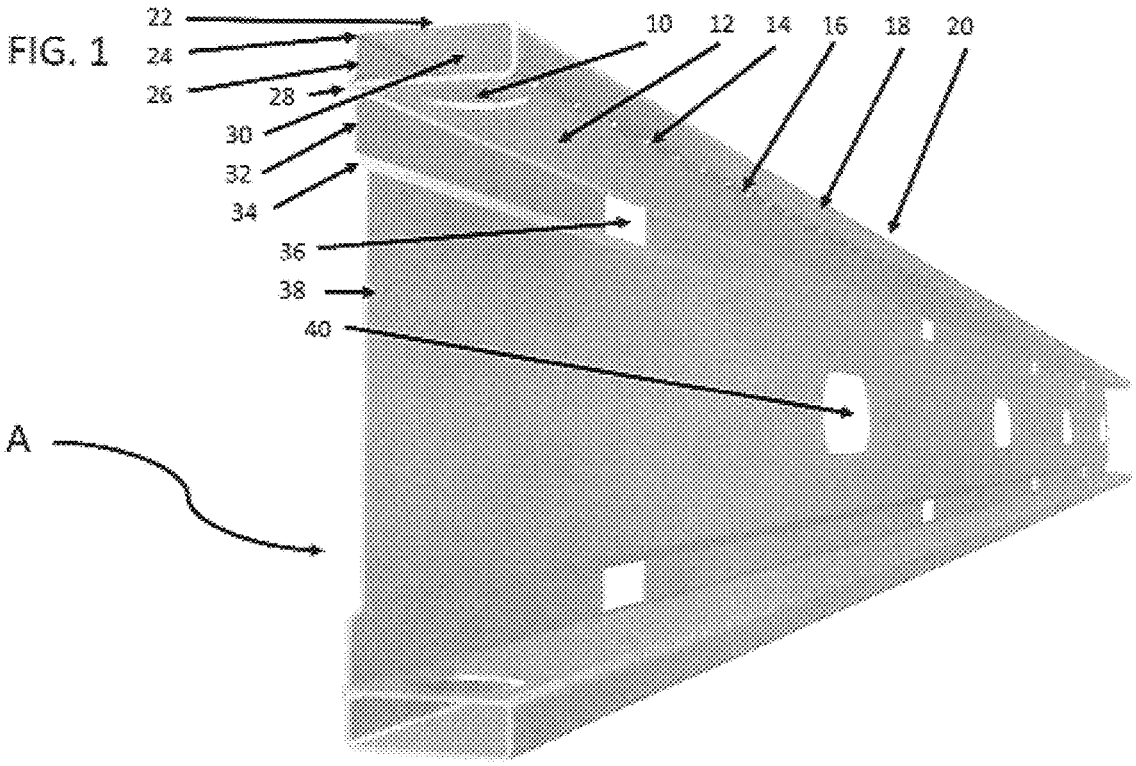
FIG. 1 is an isometric plan view of the stud.

With reference to FIG. 1, it may be observed that stud A is comprised of access hole 10 within inside flange 12, and inside flange 12 terminating at one end into slot 28 on one end and extending into bend 14 via aligned slots 16. Up 18 terminates at bend 20 which extends perpendicular to outer flange 22 which terminates at bend 24. Bend 24 terminates at outer web portion 24 which then terminates into slot 28. Slot 28 extends to web 32 which terminates into jog 34 which then terminates into inner web 28. Web 38 includes access stats 40, while web 32 includes bracing slots 36, which may be any other shape such as a "U" shape tightly fit horizontal brace (not shown).

Figure 2:
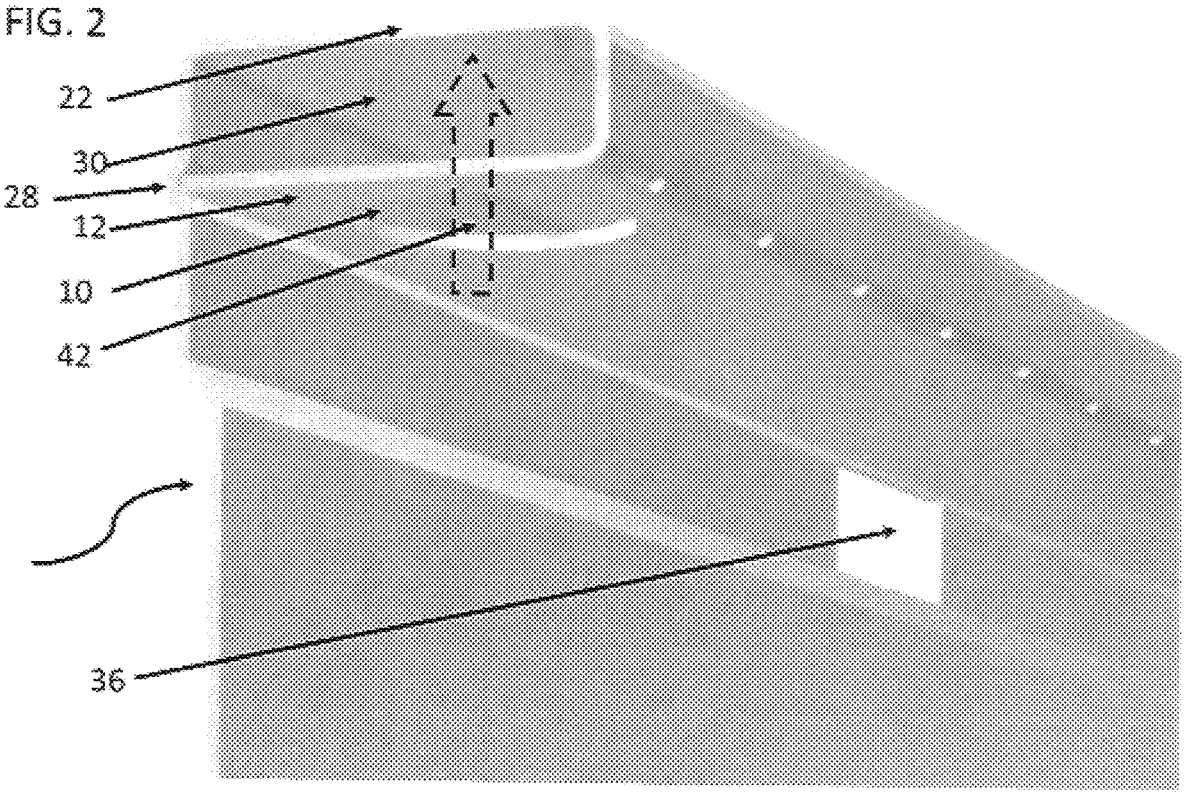
FIG. 2 is an isometric plan view of an access hole in the stud for insertion of clinching tools for mechanical joining to tracks and other studs.

FIG. 2 more clearly shows how inner flange 12 is locked into slot 28 once formed and referencing arrow 42 for where a clinching tool (not shown) would be inserted to clinch the stud to a track (not shown).

Figure 3:
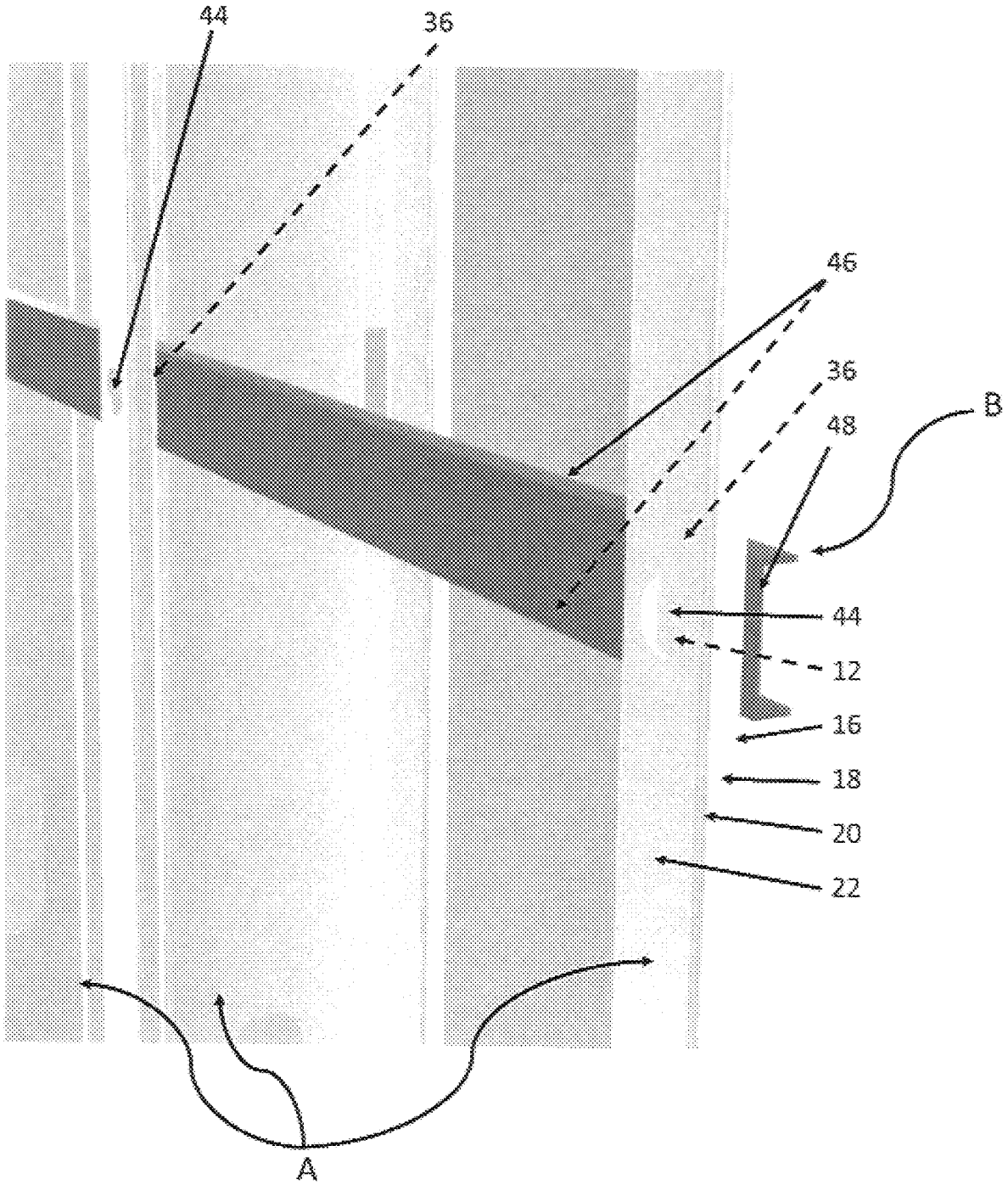
FIG. 3 is an isometric elevation view of a brace installed through the brace holes in the stud web.

FIG. 3 shows additional access holes 44 in outer flanges 36 of studs A to allow for clinching or other mechanical fastening of inner flange 12 into Brace B which consists of flanges 46 formed perpendicularly to the sides of web 42.

Figure 4:
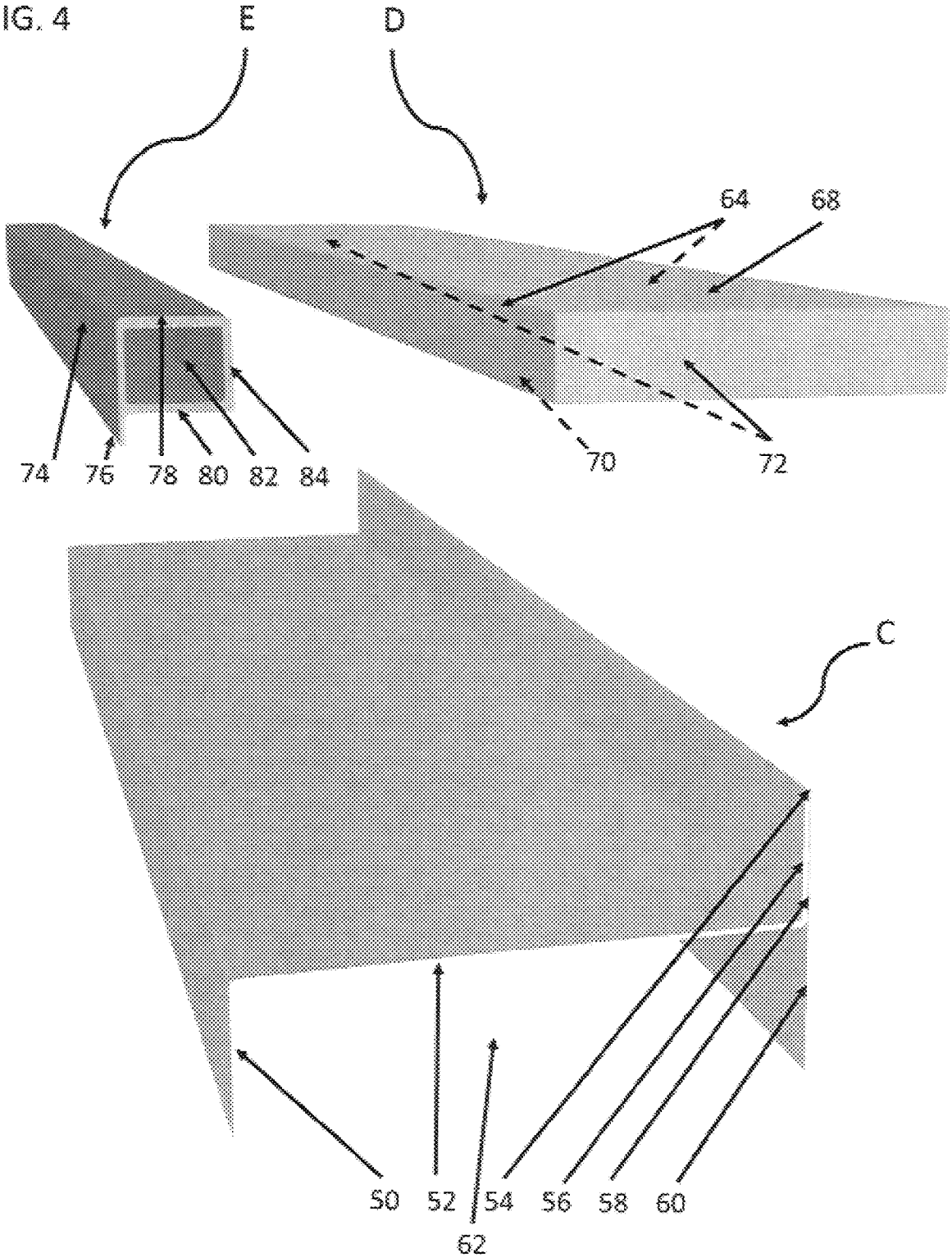
FIG. 4 is an isometric elevation view of an exploded view of a head track, neoprene gasket and rock mineral wool insulation.

FIG. 4 shows Track C, gasket D and insulation E in an exploded view, all of which may be used anywhere around the perimeter of a framed wall assembly (not shown) in more than one location, and with or without the other components. Track C may act as a stud (not shown) or add strength to a stud (not shown) by wrapping it over a stud (not shown). Track C consists of flange 50 which terminates perpendicularly to web 52 which terminates into perpendicular inner flange 56 which is parallel to flange 50. Flange 56 terminates at hem 54 which extends to outer flange 60 which is parallel and adjacently located to inner flange 56. Gap 58 is shown to be located between inner flange 56 and outer flange 60. Space 62 is located between flange 50 and parallel outer flange 60, yet below web 52. Insulation D consists of sides 64, top 68 and bottom 70 which will be adhesively adhered onto track C and gasket E. Gasket E comprises finger 76 having in-line and parallel side 74 which extends perpendicularly to top 78, which then extends perpendicularly to side 84 which is parallel to side 74. Side 84 terminates perpendicularly to bottom 80 forming a hollow box shape with space 82 inside. Gasket E is adhesively attached to track C. Adhesive 86 is shown between side 64 and bottom 70 of insulation D and inner flange 56 and gasket E side 84.

FIG. 5 shows track c assembled on 4 sides (3 sides shown) and having gasket E trapping insulation D between it and track C at the head (not marked) and right jamb (not marked) locations.

FIG. 6 shows the bottom of the assembly of FIG. 5 and showing track C on 3 sides, but with no gasket E or insulation D on the sill (not marked) or left jamb (not marked).

Figure 7:
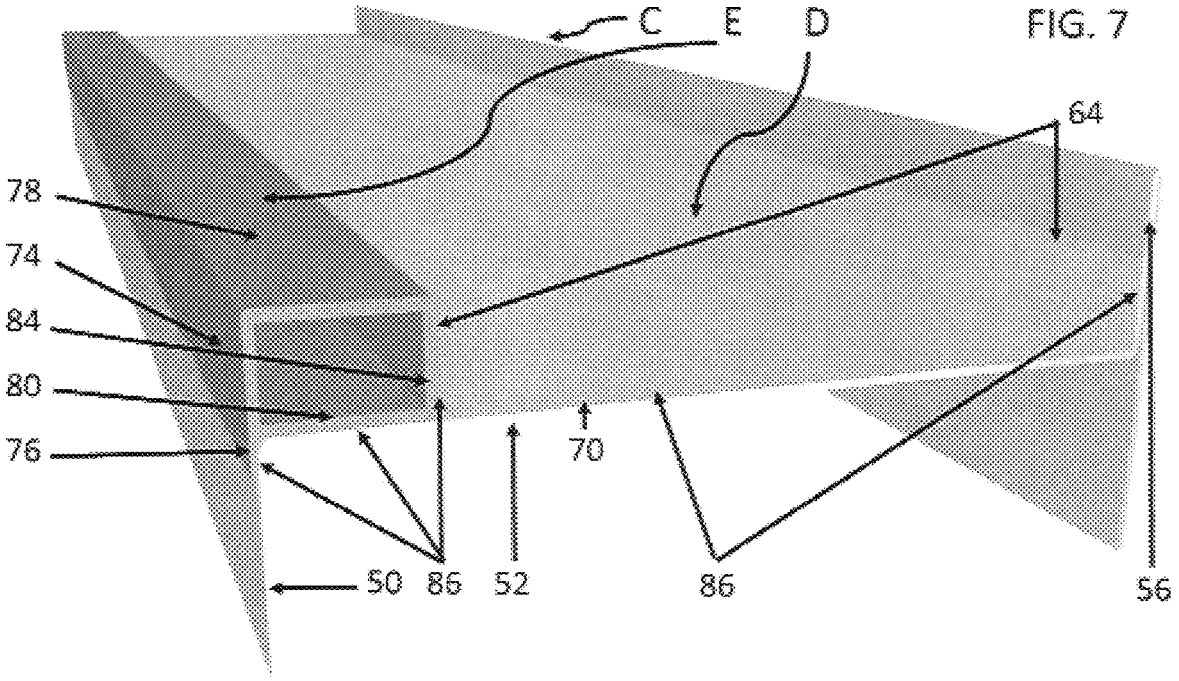
FIG. 7 shows elevation isometric cross-section view of the head track with neoprene gasket material and insulation adhered to it.

FIG. 7 shows head track C, gasket E and insulation D assembled as a complete unit.

Figure 8:
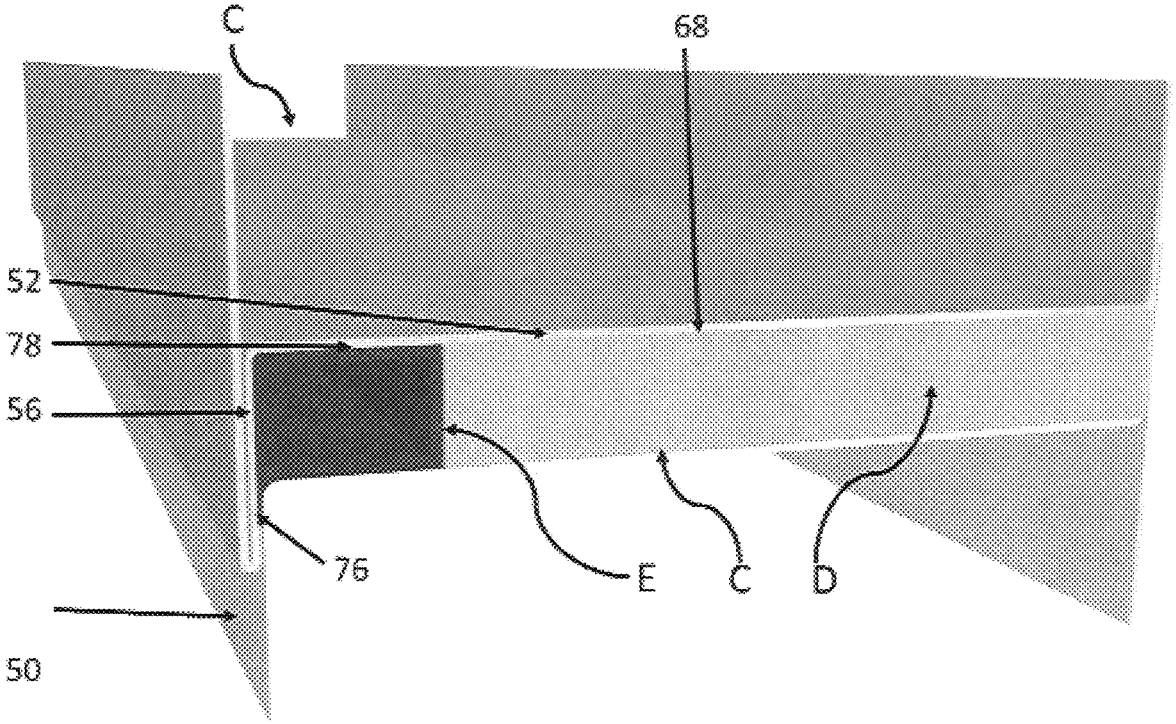
FIG. 8 shows an elevation isometric cross section view of the sill track of what is a wall panel assembly overhead being lowered onto the head track of FIG. 7, sealing over and adjacent to the neoprene gasket to prevent water intrusion, as well as resting on the rock mineral wool insulation, which springs back when compressed, to help with alignment of the two panels.

FIG. 8 shows how bottom sill C can overlap gasket E and insulation D between top sill C, which is located at the bottom of FIG. 8, to seal and prevent water (not labeled) from infiltrating as between head track C and sill track C.

FIG. 9 and FIG. 10 show Vertical thermal clip G having neoprene washer 88 under first fastener hole 90 which extends at an angle to arm 92, which extends to first hole 94, which then extends to jog 96, which then extends to second hole 98, which then extends perpendicularly to leg 100, which then extends perpendicularly to second mounting hole 102 which is on top of second neoprene washer 88.

FIG. 11 shows two vertical thermal clips G having angle-girt H mounted to it using fasteners 108. Angle-girt H is comprised of flange 104 which extends perpendicularly to flange 106.

Figure 12:
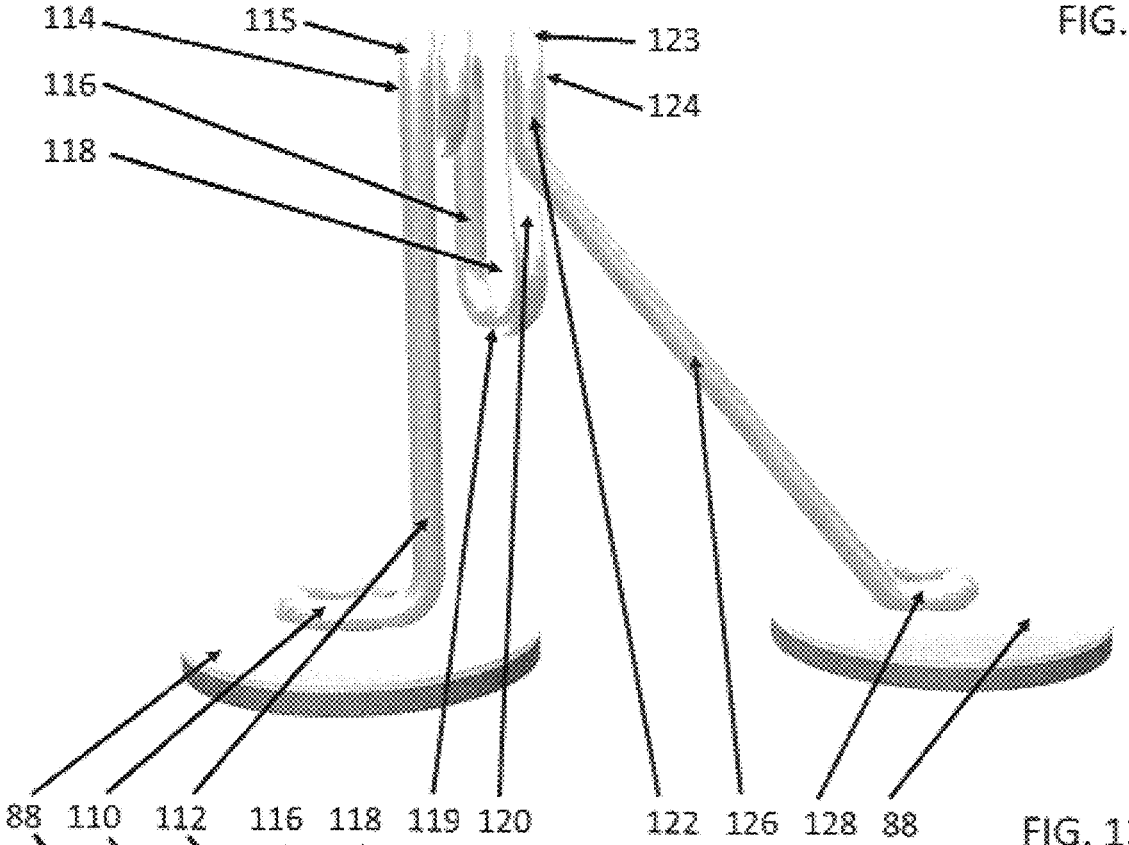
FIG. 12 shows a side elevation isometric view of the horizontal thermal clip.
Figure 13:
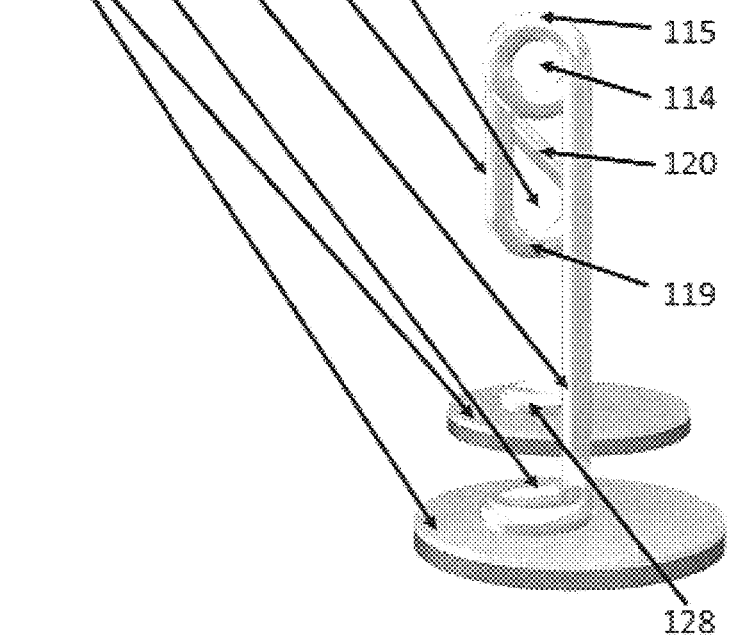
FIG. 13 shows an isometric plan view of the horizontal thermal clip looking from the bottom-up.

FIG. 12 and FIG. 13 shows first neoprene washer 88 under first mounting hole 110 which extends perpendicularly to leg 112, which then extends to coil 115 having hole 114 in the middle of it. Coil 115 extends to second leg 116 which is parallel and somewhat adjacent to leg 112. Second leg terminates at bend 119 which then extends to incline bend 120 to create opening 118. Incline bend 120 extends to acute bend 123 which extends to short leg 122 which is parallel and somewhat adjacent to second leg 116 and creates half-hole 124. Short leg 122 extends at an angle to arm 126 which extends at an angle to second mounting hole 128 which is located over the top of second neoprene washer 88.

Figure 14:
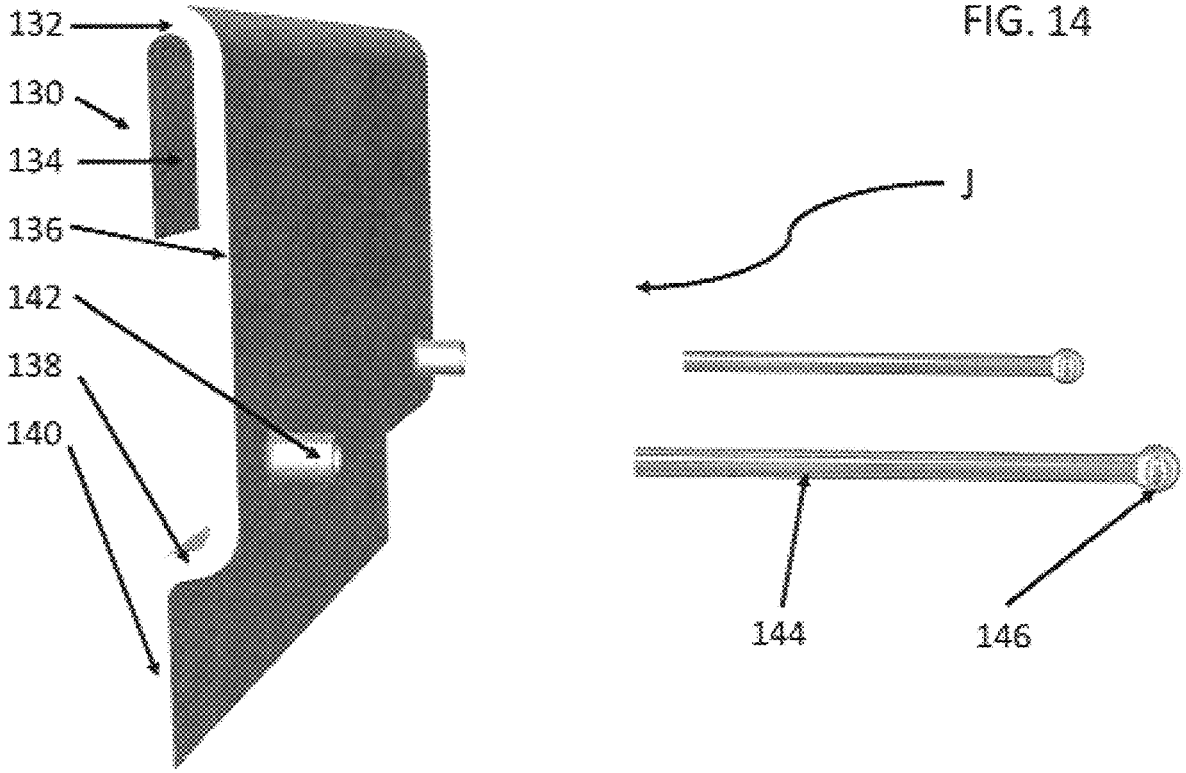
FIG. 14 shows an elevation isometric view of a formed rivet clip which has a portion of a the body of the rivet formed into tubes which would eventually have the rivet shanks installed into them.
Figure 15:
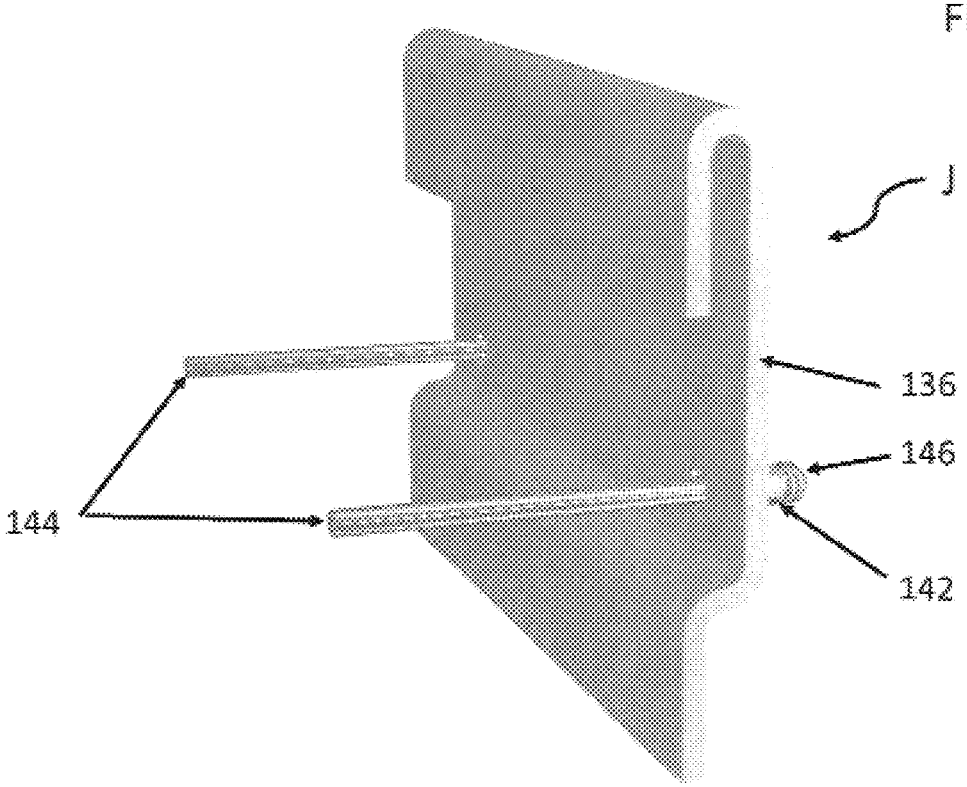
FIG. 15 shows an elevation isometric view of the rivet clip of FIG. 14 with the rivet shanks installed into the formed tube bodies.

FIG. 14 and FIG. 15 shows rivet clip J having flange 130 terminating at hem 132 which extends to leg 136 which is parallel and adjacent to flange 130 and creates gap 134 between them. Leg 136 extends to jog 138 which then further extends to small leg 140, and small leg 140 being parallel with Leg 136. Hollow protrusions 142 extend out of one side of leg 136 where rivet shank 144 will be inserted into but stopping at head 146.

Figure 16:
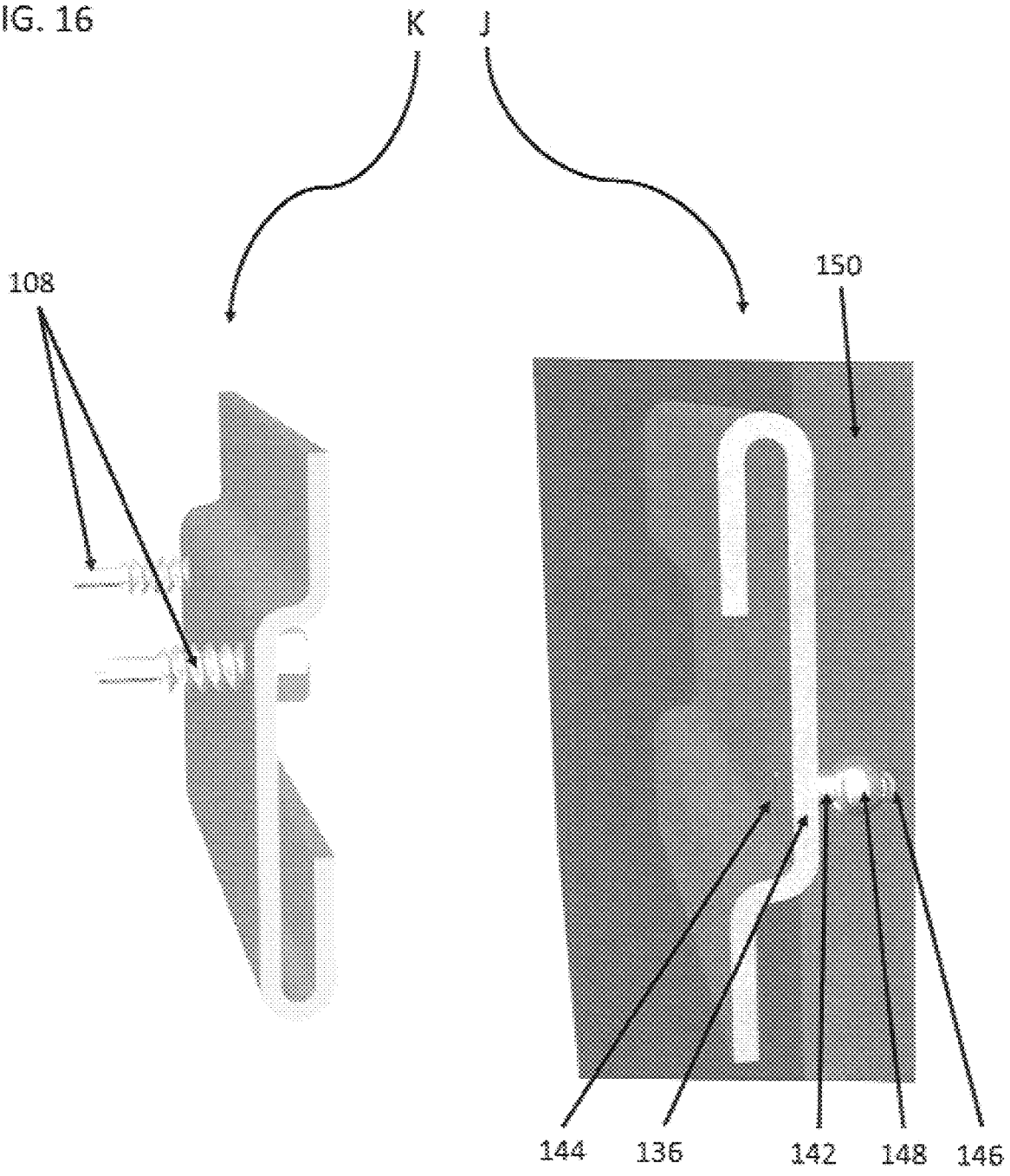
FIG. 16 shows an elevation isometric view of the rivet clip of FIG. 15 having the rivet shanks pulled into the formed tube bodies and expanding them inside a façade material so that the rivet clip is permanently attached to the façade material. Both rivet shanks have snapped off flush with the face of the rivet clip.

FIG. 16 shows horizontal sub-girt K which is adjacent to rivet-clip J, but with rivet-clip J having rivet head 146 forced to extend into rivet body 142 which is then expanded into façade 150 for permanent attachment.

Figure 17:
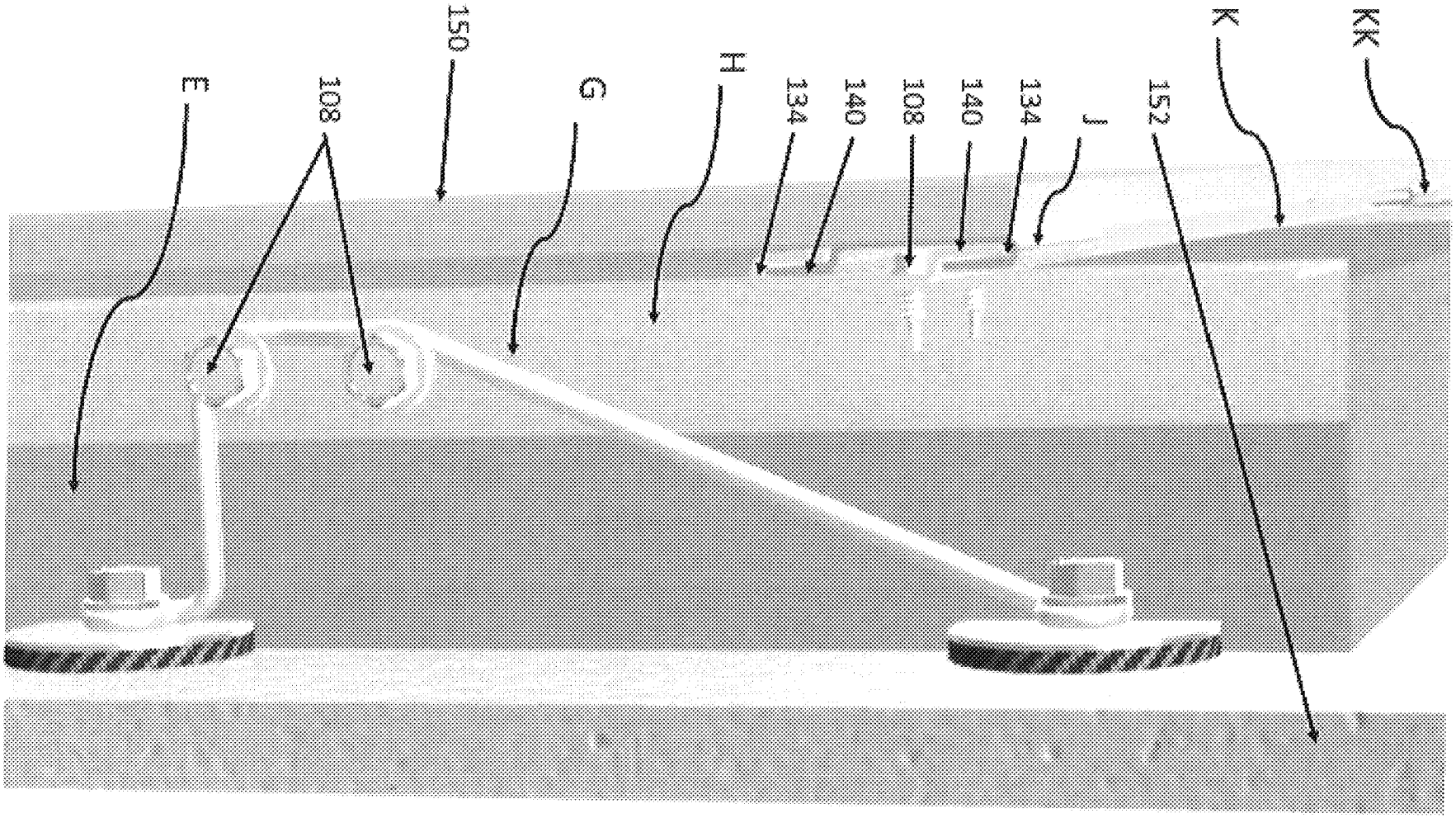
FIG. 17 shows an elevation isometric view of a partial wall assembly with the vertical thermal clip supporting an L-angle sub-girt which then has an inverted non-riveted rail of the same shape attached to it. The rivet clip is inverted to the non-riveted rail for permanent attachment.

FIG. 17 shows horizontal sub-girt K attached to vertical angle-girt H, which is attached to vertical thermal clip G via fasteners 108 which extend through sheathing 152. Clip J is mounted over horizontal sub-girt K for permanent fixing.

Figure 18:
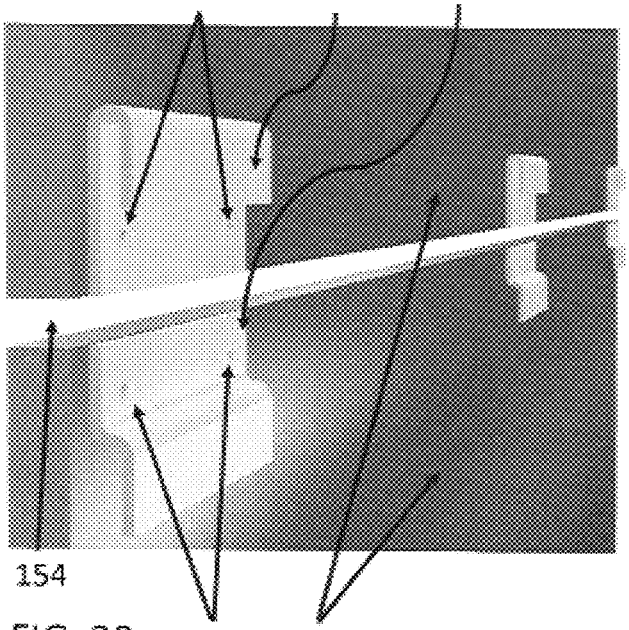
FIG. 18 shows an elevation isometric view of the rivet clip of FIG. 15 cut in half and having two rivet shanks in each half, showing that a façade panel can be supported by less than a whole clip.

FIG. 18 shows former clip J separated into two parts, hemmed top L and Z-bottom L-L, both of which have two embodied rivets 144, and gap 154 between panels 150.

Figure 19:
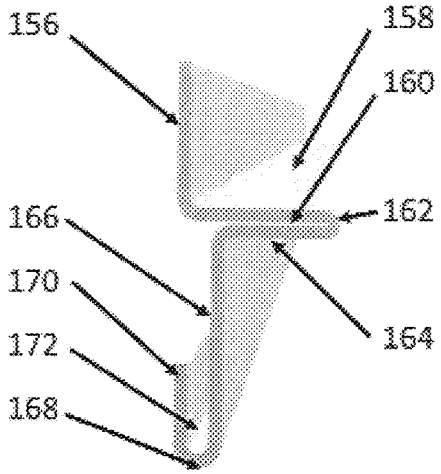
FIG. 19 shows an elevation isometric view of a formed horizontal sub-girt having two attachment points, one for the panel below and one for the panel above.

FIG. 19 shows formed horizontal sub-girt M having leg 156 extending to perpendicular arm 158 which terminates at hem 162. Hem 162 terminates perpendicularly to second arm 164 which is parallel and adjacent to arm 158 and creates gap 160 between them. Second arm 164 extends perpendicularly to second leg 166 which extends to hem 168 which extends perpendicularly to arm 170 which is parallel and near second leg 166 and forming gap 172 between them.

Figure 20:
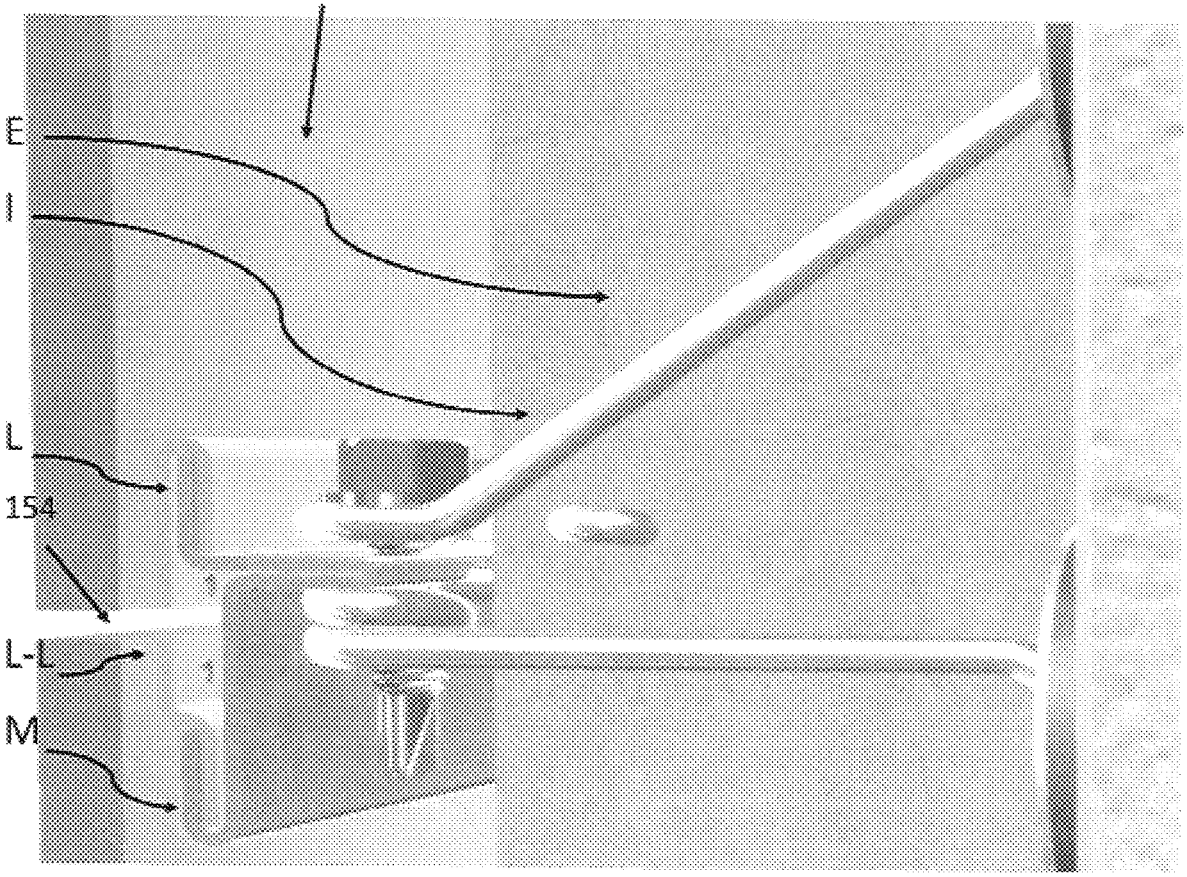
FIG. 20 shows an elevation isometric view of the formed horizontal sub-girt of FIG. 19 supporting the upper and lower panels of FIG. 18.

FIG. 20 shows hemmed top L of FIG. 18 and Z-bottom L-L of FIG. 19 in an assembly and mounted to horizontal sub-girt M of FIG. 19, which is attached to horizontal thermal clip I. Horizontal thermal clip I frictionally fits insulation E between them when several are mounted to studs parallel to each other (not shown).

FIG. 21 shows horizontal sub-girt fiber reinforced pultrusion N having upper arm 174 extending downwards to perpendicular legs 176 and 180 which are parallel to each other with space 178 between them. Arm 174 continues past perpendicular arms 176 and 180 to become leg 182 which then extends to hem 186 which extends to riser 184 which is parallel and adjacent to leg 182 and creates gap 188 between them.

FIG. 22 shows horizontal extruded clip O having arm 190 extending to hem 192 which extends perpendicular to second arm 194 to create space 196 between them. Second arm 202 extends to perpendicular hem 198 which then extends perpendicularly to third arm 200 which is parallel to second arm 202 and creates gap 202 between them. Second arm also continues downward to leg 204 which extends further to terminate at end 212. Prior to terminating at end 212, hem 206 extends off the same side of leg 204 at hem 198, which then extends perpendicularly to fourth leg 208 to create gap 210 between it and leg 204.

FIG. 23 shows rivet clip Q having leg 214 extending to hem 216 which extends to arm 218 which is parallel and adjacent to leg 214 and having gap 220 between them. Arm 218 extends straight to become body 222 which terminates at end 224. Prior to terminating at end 224, hem 228 extends off the same side as hem 216, which then extends perpendicularly to arm 226 having gap 230 between arm 226 and end 224.

FIG. 24 shows Pultrusion N assembled with extruded clip O which is supporting rivet clip Q which is attached to façade panel 150.

Figure 25:
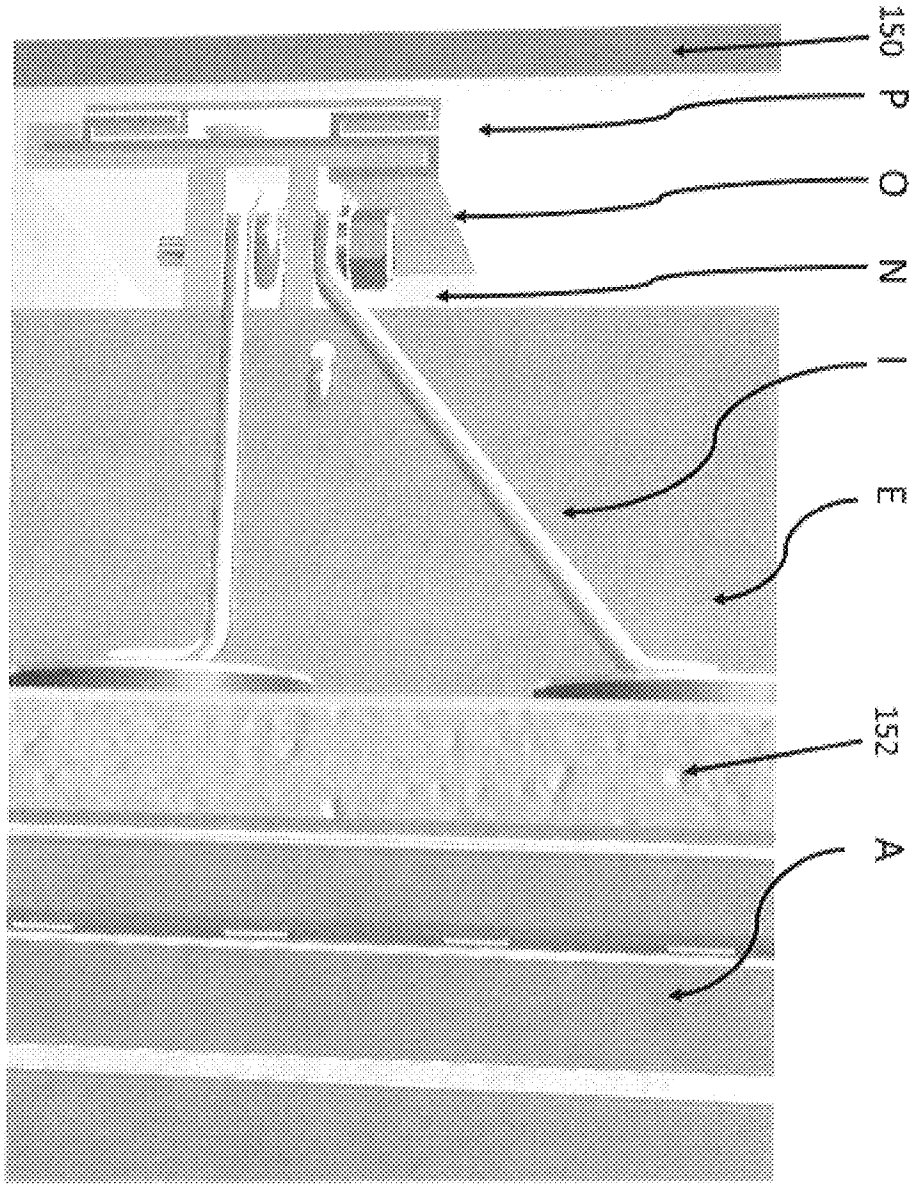
FIG. 25 shows an elevation isometric view of the assembled components of FIG. 24 attached over and in the horizontal thermal clip of FIG. 12 which is then attached through a weather barrier and sheathing and ultimately into the stud of FIG. 1.

FIG. 25 shows the assembly of FIG. 24 to further include pultrusion N wrapped around and fastened to horizontal sub-girt.

FIG. 26, FIG. 27 and FIG. 28 shows pem-rivet Q having shank 230 ending in head 232. Shank 230 is encompassed by rivet body 240 having hollow center 242 extending through to end 234. Rivet body 240 extends directly to hex base 238, which extends directly and in-line with rivet head 236.

FIG. 29 shows pem-rivets Q inserted into clip P with hex base 238 flush with back 150 of clip and shanks 230 extending out the front of clip P.

Figure 30:
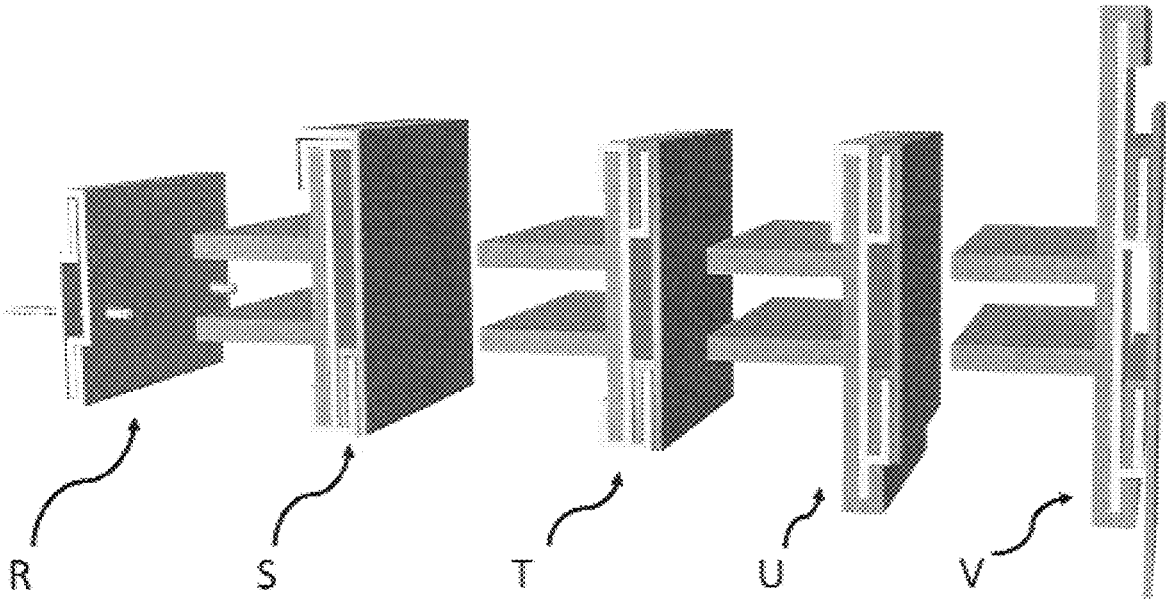
FIG. 30 shows an elevation isometric view of different variations of pultrusions, extrusions and formed sheets as clips and sub-girt structural options, and how they connect.

FIG. 30 shows variations R, S, T, U and V of pultrusion and extruded horizontal sub-girt assemblies with clips.

Figure 31:
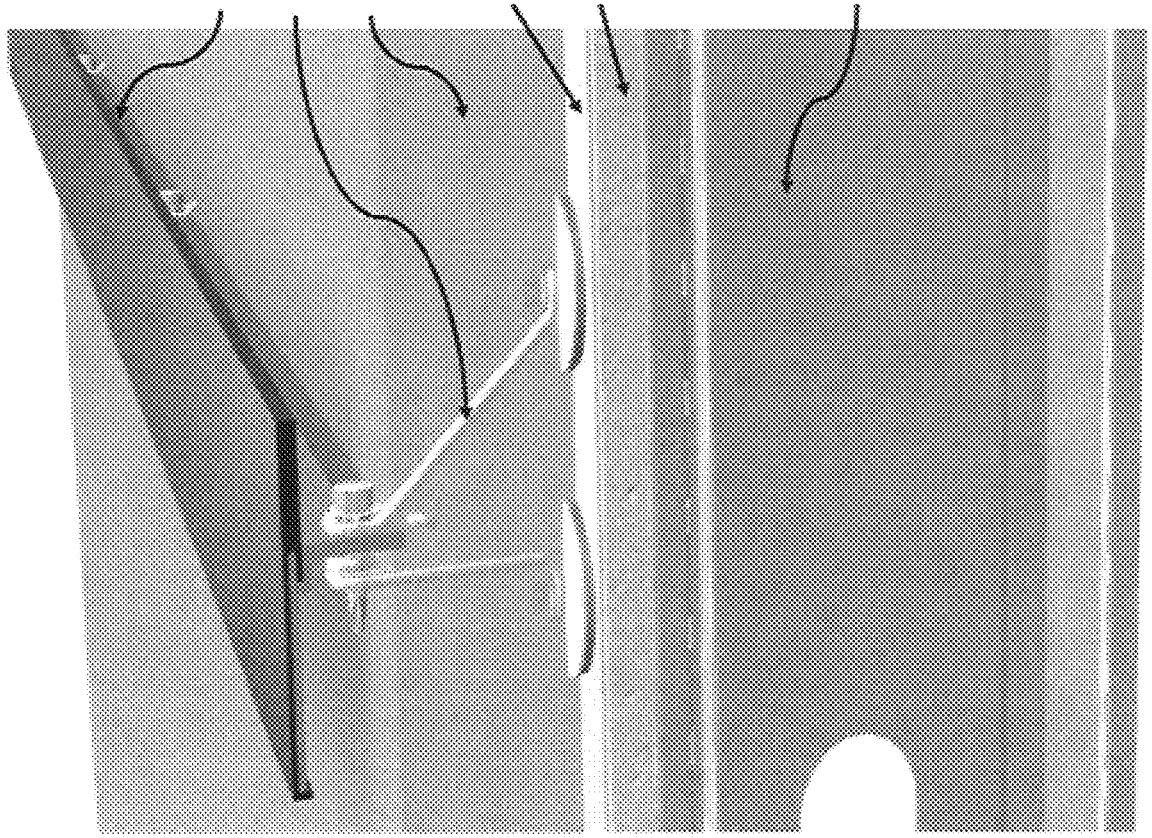
FIG. 31 shows an isometric elevation view of the preferred embodiment of the present invention, including a T-shaped pultrusion mounted inside of the horizontal thermal clip of FIG. 12 and having an extrusion T-extension frictionally mounted over the top it with or without adhesives between them. The horizontal thermal clip is then mounted through a weather barrier and sheathing and into the steel stud of FIG. 1.

FIG. 31 shows horizontal sub-girt assembly W installed onto horizontal thermal clip I.

All aspects of the current invention may be used in conjunction with aspects of other similar inventions that I have been involved with to create hybrid products and systems without departing from the current invention as it should be considered "known".

The invention claimed is:

1. A premanufactured wall assembly system comprising:

a horizontal thermal clip having a first washer under a first mounting hole, said first mounting hole extends perpendicularly to a first leg, said first leg then extends to a coil with a hole in center, wherein said coil extends to a second leg which is parallel and adjacent to said first leg, wherein said second leg terminates at a bend, said bend then extends to an incline bend to create an opening, said incline bend extends to an acute bend, said acute bend extends to a short leg which is parallel and adjacent to said second leg and creates a half-hole, said short leg extends at an angle to an arm, said arm extends at an angle to a second mounting hole which is located over the top of a second washer, at least one vertical thermal clip having a first washer under a first mounting hole, said first mounting hole extends at an angle to an arm, said arm extends to a first hole, said first bole then extends to a jog, said jog then extends to a second hole, said second hole then extends perpendicularly to a leg, said leg then extends perpendicularly to a second mounting hole which is on top of a second washer, a roll formed stud having an access hole within an inside flange, said inside flange terminating into a slot on one end and extending into a first bend via aligned slots forming a lip, said lip terminates at a second bend, said second bend extends perpendicular to an outer flange, said outer flange terminates at a third bend, said third bend terminates at an outer web portion, said outer web portion then terminates into said slot, said slot extends to an outer web, said outer web terminates into a jog, said jog then terminates into an inner web, a horizontal sub-girt having a first leg extending to a first arm, said first arm terminates at a first hem, said first hem terminates perpendicularly to a second arm which is parallel and adjacent to said first arm and creates a first gap therebetween, wherein said second arm extends perpendicularly to a second leg, said second leg extends to a second hem, said second hem extends perpendicularly to a third arm which is parallel and adjacent to said second leg and forming a second gap therebetween, and a rivet clip having hemmed top and Z-bottom.

2. The system of claim 1, further comprises a pultrusion wrapped around and fastened to said horizontal thermal clip.

3. The system of claim 1, further comprises a horizontal sub-girt assembly installed onto said horizontal thermal clip.

4. The system of claim 1, further comprises a horizontal sub-girt attached to a vertical angle girt which is mounted to a pair of said vertical thermal clips.

5. The system of claim 1, wherein said hemmed top and Z-bottom comprises a pair of embodied rivets, and a gap therebetween panels.

6. The system of claim 1, wherein said hemmed top and Z-bottom in an assembly, mounted to said horizontal sub-girt, which is attached to said horizontal thermal clip, wherein said horizontal thermal clip frictionally fits insulation therebetween.

* * * * *